US006256960B1

(12) United States Patent
Babcock et al.

(10) Patent No.: US 6,256,960 B1
(45) Date of Patent: Jul. 10, 2001

(54) MODULAR BUILDING CONSTRUCTION AND COMPONENTS THEREOF

(76) Inventors: Frank J. Babcock, 6301 Shasta Creek Way, Elk Grove, CA (US) 95758; Reginald D. Smith, 20395 N. Dustin Rd., Acampo, CA (US) 95220; Jeffrey R. Scuka, 10026 E. Harney La., Lodi, CA (US) 95240

( * ) Notice: Subject to any disclaimer, the term of this patent is extended or adjusted under 35 U.S.C. 154(b) by 0 days.

(21) Appl. No.: 09/289,848

(22) Filed: Apr. 12, 1999

(51) Int. Cl.[7] ..... E04B 2/00

(52) U.S. Cl. ..... 52/592.1; 52/281; 52/586.2; 52/794.1; 52/309.11; 52/309.7; 52/295; 52/293.3

(58) Field of Search ..... 52/293.3, 295, 52/309.7, 309.11, 592.1, 586.2, 794.1, 93.2, 92.2, 309.9, 281, 223.1, 91.1, 92.1, 90.1, 537, 783.11, 783.14, 783.19

(56) References Cited

U.S. PATENT DOCUMENTS

| | | | | |
|---|---|---|---|---|
| 3,170,269 | * | 2/1965 | Dunnington | 52/92.2 |
| 3,350,828 | * | 11/1967 | Russell | 52/281 |
| 3,482,367 | * | 12/1969 | Curran | 52/309.9 |
| 3,591,993 | * | 7/1971 | Reeves | 52/794.1 |
| 4,037,377 | * | 7/1977 | Howell et al. | 52/309.9 |

(List continued on next page.)

OTHER PUBLICATIONS (brochure) Innovative Builders; Force 10, Building Solutions for the Caribbean; date unknown.

(brochure) Vision Building Products, Inc.; Mahoney / Tri Chord EESI™ Building Panel; date unknown.

(catalog) Advanced Foam Plastics, Inc.; Construction Details, R Control Structural Building Panel; date unknown; front and rear covers, and pp. 2, 15, 18, 19, 25–27.

(brochure) IPS Insulated Panel Systems; TecFoam™ Insulated Wall and Roof Panel; date Apr. 1997.

(brochure) Extreme Panel Technologies; Extreme Panel Technologies; date unknown.

(brochure) Precision Panel; Structural Insulated Panels; date unknown.

(article) Structural Insulated Panel Assn and Society of the Plactics Industry; Structural Insulated Panels, Strength and Energy Performance Properties of Foam–Core Sandwich Panels; date 1994.

(List continued on next page.)

*Primary Examiner*—Carl D. Friedman
*Assistant Examiner*—Dennis L. Dorsey
(74) *Attorney, Agent, or Firm*—R. Michael West; Boutin, Dentino, Gibson, Di Giusto, Hodell & Wes

(57) ABSTRACT

A modular building construction and components thereof. A foundation for a building includes anchor bolts extending around its periphery. A metal lower track is installed over the anchor bolts and secured thereto with nuts and rod couplers. Elongated connector rods are threaded onto the upper ends of the couplers. Pre-manufactured modular wall panels, integrally molded with a metal stud along a first lateral edge and a complementary recess along a second lateral edge, are successively installed in the track. A first panel is installed with an open side of the stud surrounding the connector rod. The second, adjacent panel is installed with its second lateral edge facing the stud. The two panels are slid together to surround and enclose the connector rod. The process continues until the entire peripheral wall is formed. A metal upper track is laid over the upper ends of the wall panels with the connector rods extending therethrough. Nuts are used to secure the wall, track, rod, and foundation together, applying compressive forces through the assembled components. A roof assembly, including modular roof panels and a ridge beam, is also described.

16 Claims, 9 Drawing Sheets

U.S. PATENT DOCUMENTS

| | | | | |
|---|---|---|---|---|
| 4,125,984 | * | 11/1978 | Jonas | 52/809 |
| 4,443,988 | * | 4/1984 | Coutu, Sr. | 52/309.9 |
| 4,837,999 | * | 6/1989 | Stayner | 52/309.11 |
| 4,989,386 | * | 2/1991 | Collis | 52/295 |
| 5,021,108 | | 6/1991 | Bergqvist . | |
| 5,121,583 | * | 6/1992 | Hirai et al. | 52/90 |
| 5,152,114 | * | 10/1992 | Beazley et al. | 52/92.2 |
| 5,497,589 | * | 3/1996 | Porter | 52/309.9 |
| 5,638,651 | * | 6/1997 | Ford | 52/309.9 |
| 5,842,315 | * | 12/1998 | Lin | 52/309.9 |
| 6,085,485 | * | 7/2000 | Murdock | 52/783.19 |

OTHER PUBLICATIONS (brochure) Steelspan; Steelspan Homes, The Energy Efficient Home Built From Steel for Safety, Comfort and Durability; date unknown.

(brochure) Imperial Manufacturing; R–Plus Super Insulated Homes; date unknown.

(brochure) Insulspan; The SIP Advantage; date 1997.

* cited by examiner

MODULAR BUILDING CONSTRUCTION AND COMPONENTS THEREOF

BACKGROUND OF THE INVENTION

1. Field of the Invention

The invention relates generally to structures which are assembled from modular components, pre-manufactured at a plant and subsequently assembled into a complete home or building at a remote site. More specifically, the invention pertains to a building system using a plurality of structural insulated panels which are assembled together quickly and easily using a special connector system requiring no special tools or skills.

2. Description of the Prior Art

There are many conventional construction techniques currently in use in the small building and housing industries. These techniques include wood frame construction, masonry frame construction, and light-gauge steel construction. Each of these construction techniques has its own advantages and disadvantages, taking into consideration various factors such as cost, energy efficiency, durability, aesthetics, difficulty of assembly, and reliance upon special tools or components which may be necessary for assembly.

Wood frame construction is currently the most commonly used system for residential construction. Although wood as a construction material remains relatively inexpensive, there is growing concern over the quality and quantity of the world's dwindling wood supply. These concerns are particularly acute in countries where native forests have been depleted, and reforestation is not practiced. In terms of difficulty in assembly, wood frame construction requires a basic knowledge of the structural characteristics and capabilities of a variety of wood products and pieces. The carpenter must also have adequate skills and experience to employ the appropriate framing techniques for the structural project at hand. Further, the connection system for the wood components relies upon mechanical fasteners. These fasteners must be selected and assembled through the application of professional skills.

Masonry frame construction is still used in many parts of the world, particularly in third-world countries. Masonry construction can be inexpensive if the raw materials are available locally and the components are manufactured close to the building site. Nevertheless, proper assembly of masonry blocks is labor intensive, time consuming, and requires a fairly high level of skill and experience. After the blocks have been assembled, a suitable roof system must still be constructed and structurally integrated with the upper layer of wall blocks. The point of connection between the walls and the roof is critical, as high winds may cause a catastrophic separation of the two, if the connection is defective or weak. Masonry construction is also subject to damage or complete failure as the result of earthquakes, prevalent in many areas where such construction is commonly undertaken.

A third prior art construction technique which has become more popular in recent years for both commercial and residential structures, is light-gauge steel construction. One advantage of such steel construction is that is does not directly, at least, have a negative impact on the world's forests. Also, steel construction is relatively light weight, and pest-proof However, a disadvantage is that steel construction is structurally similar to wood frame construction, and requires an even higher level of construction knowledge and on-site training. The connection system for steel structural and panel components is based entirely upon mechanical fasteners. The assembly of components with such fasteners must be done properly, through the application of learned skills and the use of necessary tools.

More recently, yet another building technique, using Structural Insulated Panels ("SIPS"), has emerged. In a standard SIPS system, a pre-manufactured panel replaces the framing, sheathing, and insulation used in prior art construction. Typically, a SIP includes either polystyrene foam or polyurethane foam as material for its core. This rigid and dense foam spans the entire thickness of each panel, and provides a desirably high R-factor. Consequently, structures made from SIPS are generally stronger, more energy efficient, and offer a higher and more consistent level of quality than structures employing wood frame construction. However, the fastening system used in the standard SIPS system is similar to that used in wood frame construction. Even though assembly of the standard SIPS system requires a lower degree of construction knowledge than that necessary for wood-stick framing, it still requires basic carpentry skills and the use of heavy equipment to move and locate the large panels which are usually employed.

SUMMARY OF THE INVENTION

The present invention employs a plurality of Structural Insulated Panels having a relatively small size, compared to prior art designs. These smaller SIPS can easily be moved, arranged, and secured into place, without the use of heavy equipment or other special tools.

The SIPS wall panels are generally constructed from a foam core, sandwiched between inner and outer parallel skins of finished sheet material. At the time the foam core is molded, each SIPS is structurally integrated with a steel stud, located along a first vertical edge of the panel and partially protruding therefrom. The steel stud is generally U-shaped, in cross-section, having an open side extending from the top to the bottom of the panel. Each panel also includes a second vertical edge, along which the outer face of the foam core is slightly recessed. The combination of the recessed foam and the outer edges of the skins provides a channel extending from the top to the bottom of the panel.

A lower metal track, secured to a cement or block foundation through the use of spaced anchor or "J" bolts, defines the perimeter wall of the structure to be built. Nuts are provided over some of the anchor bolts, while threaded rod couplers are provided over others. The location of the anchor bolts with the threaded couplers corresponds to the location of a respective vertical connector rod. These threaded connector rods comprise the heart of the special connection system which secures the panels and a modular roof system together.

The lower edges of adjacent panels are first aligned with the track, and then lowered into the track. A first vertical edge, containing the stud, and the second vertical edge containing the channel, are slid together with the vertical connector rod extending therebetween. Adjacent edges of the skins for each panel are spaced approximately 3/16" apart, while overlapping and substantially covering inner and outer edges of the stud. Self-drilling screws are screwed through the skin and extending side portions of the lower track, then into the steel connecting stud to secure the panels in place.

An upper metal track overlies the upper edges of the panels, and overlaps the joints therebetween. The upper track is generally coextensive with the lower metal track, and may include portions having an inclined upper surface to correspond to the desired pitch of the roof system. The upper track includes apertures through which the upper ends of the connector rods pass. Nuts are screwed and tightened over the connector rods, vertically compressing the panels while securing them to the foundation.

A modular roof system may also be used with the SIPS wall panel construction, just described. Modular roof panels, similar to the modular wall panels, include a foam core sandwiched between a corrugated metal outer skin and a generally planar inner skin. The roof panels are preferably long enough to extend in one continuous piece from a ridge beam assembly over and past the upper track of the wall panels to form an overhang around the building.

A metal stud extends along one edge of each roof panel, between the outer skin and the inner skin. The outer skin extends laterally past the metal stud, to form a specially configured overlapping portion. The configuration of this overlapping portion conforms to a corresponding structure on an adjacent panel. The lower side of the stud extends past the lateral terminus of the inner skin, leaving a section of the lower side exposed. The inner volume of the stud is filled with a portion of the foam comprising the foam core, structurally integrating the two.

Along the other edge of each roof panel, the lateral terminus of the outer skin is flush with the foam core, and the lateral terminus of the inner skin extends past the foam core.

Adjacent roof panels are joined by sliding the two panels laterally together, with the one edge containing the stud abutting the other edge having the foam and the outer skin flush. The overlapping portion of the outer skin of one panel slides over a corresponding configuration on the adjacent panel. The lateral extension of the inner skin of the adjacent panel slides over the exposed lower side of the stud. Screws are used to secure the lateral extension to the stud and the overlapping portion to the underlying corresponding configuration on the adjacent panel.

The ridge beam assembly is comprised of a box beam supporting a ridge beam. The ridge beam includes a pair of open flanges, or receiver channels, extending laterally along either side of the beam. The box beam extends from one end of the structure to the other, or between other posts or vertical supports capable of supporting the weight of the roof The open flanges of the ridge beams are sized and configured to accept the upper ends of the roof panels. Special self-drilling roof panel fasteners are screwed through an upper side of a ridge beam, through the roof panels, and into a lower side of the ridge beam and the box beam. These same roof panel fasteners are used to connect the roof panels to the upper track overlying the wall panels in a similar fashion.

It is an object, therefore, of the present invention to provide a building system utilizing modular components which are lightweight, strong, energy efficient, and easy to assemble;

It is a further object to provide special connectors and interlocking features for assembling modular wall and roof panels;

It is another object to provide a wall construction using modular panels assembled with upper and lower metal tracks and connection rods;

It is yet another object to provide modular wall and roof panels having a foam core and inner and outer skin material, and including a metal stud which extends along one edge of the panel and is structurally integrated therewith;

These and other objects of the present invention will become apparent in the detailed description and the accompanying drawings to follow.

DETAILED DESCRIPTION OF THE PREFERRED EMBODIMENT

Figure 1:
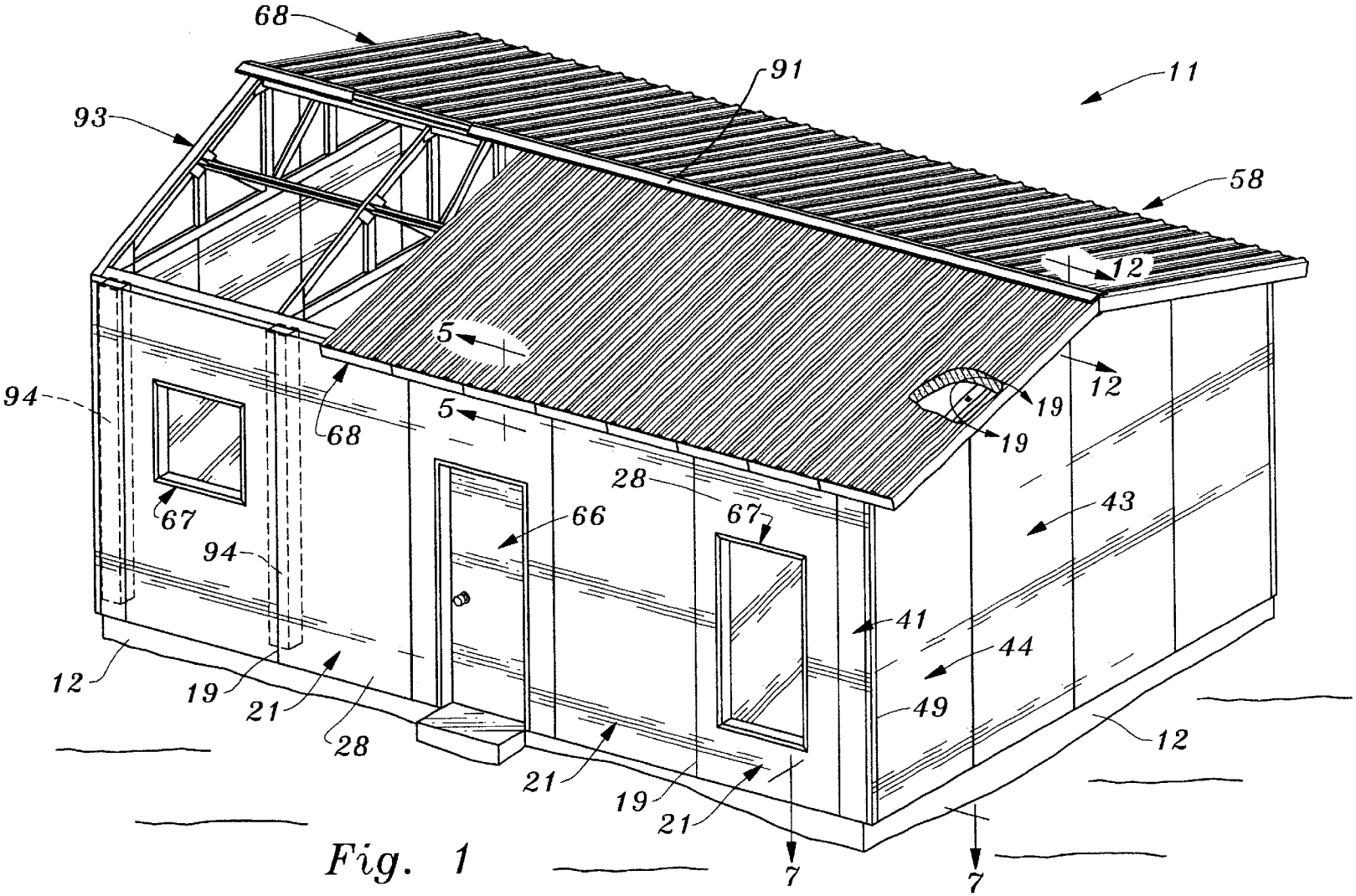
FIG. 1 is a right front perspective view of a typical building, using the modular panel and connection system of the present invention.
Figures 2, 3, 3A:
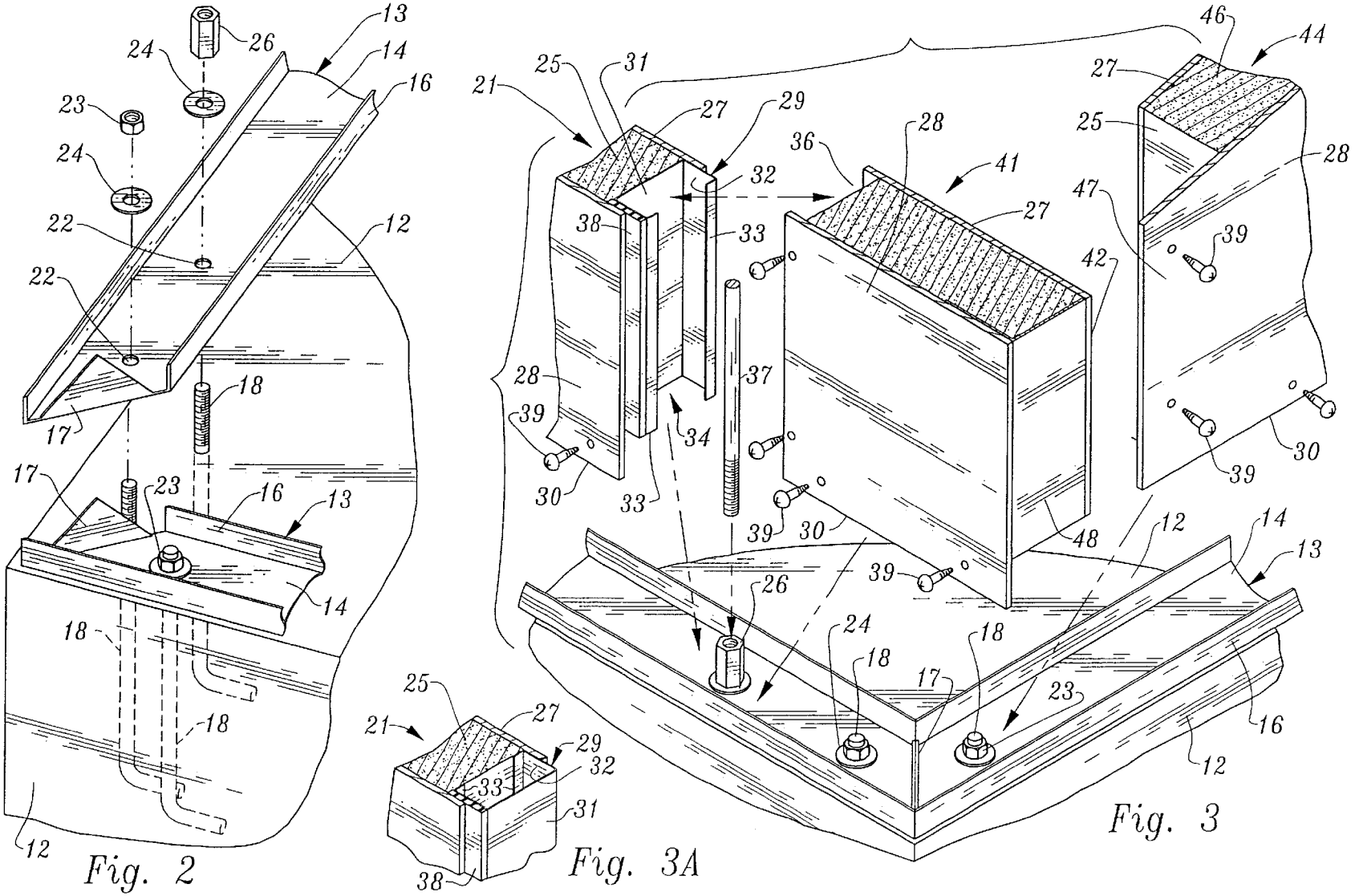
FIG. 2 is a fragmentary perspective view of typical foundation corner, showing lower tracks being secured to the foundation with anchor bolts, nuts, and rod couplers.
FIG. 3 is a fragmentary perspective view of a typical lower corner, showing portions of three wall panels and a threaded connection rod.
FIG. 3A is fragmentary, perspective view, showing of an upper end of an alternative construction for an eave panel.
Figure 15:
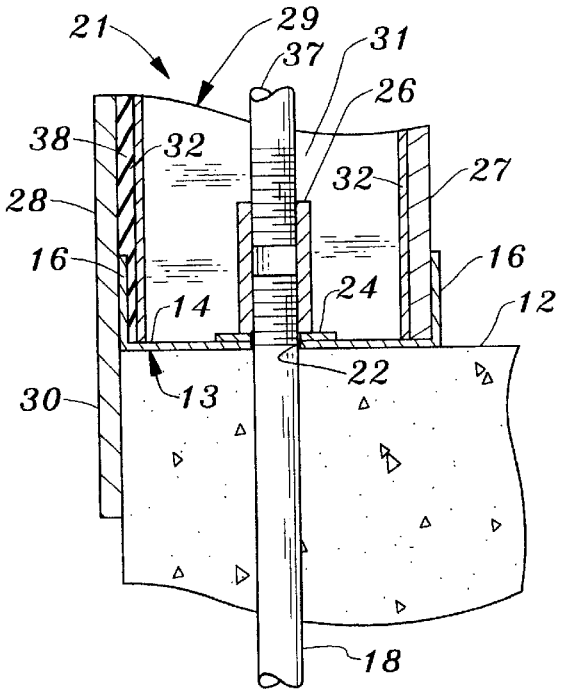
FIG. 15 is a fragmentary, cross-sectional view through the foundation, a wall panel, an anchor bolt and a connector rod, showing a first embodiment of a lower track.

Turning now to FIG. 1, a building 11 is shown which uses the modular Structurally Integrated Panels (SIPS) and the connection system of the present invention. The building 11 is constructed on a foundation 12, which is preferably a concrete slab. Other constructions, however, may be used for the foundation 12, such as a perimeter footing wall of concrete or concrete blocks in conjunction with dirt fill and panel flooring. Extending around the perimeter of the upper surface of the foundation is a lower track 13, preferably manufactured from pieces or sections of thin steel, or other bendable or moldable material. Four different configurations for the track 13 are disclosed herein, although the preferred configuration, shown in FIGS. 2, 3 and 15, is generally U-shaped in cross-section. Track 13 includes a horizontal portion 14 and upwardly extending side portions 16. At each corner of the building, angularly abutting pieces of the lower track 13 are cut on the building site to fit so they will meet in flush engagement, as shown in FIG. 3. Material remaining after the cutting, such as ears 17, may be bent upwardly, out of the way.

Figure 4:
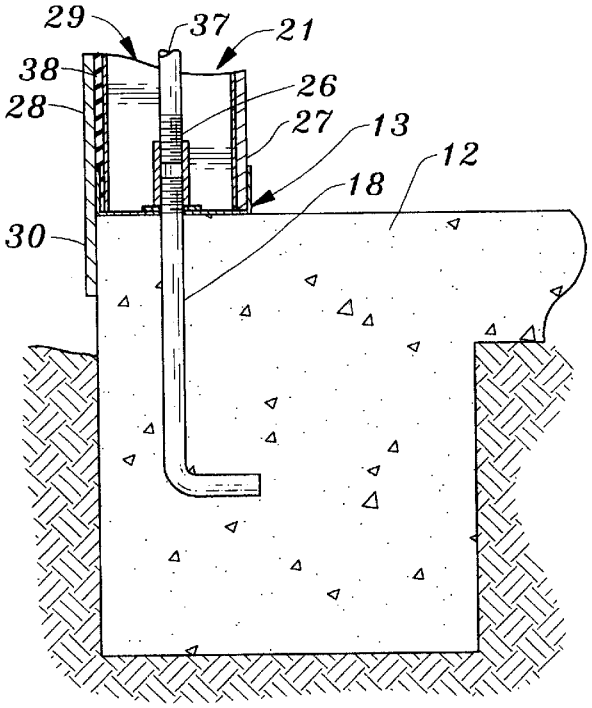
FIG. 4 is a fragmentary, vertical, cross-sectional view, taken through a typical connection rod, showing the anchor bolt, the lower track, and a portion of a modular wall panel.

The lower track is secured to the foundation 12 by a plurality of threaded anchor, or "J" bolts 18, or equivalent fasteners, pre-arranged around the perimeter of the foundation before the concrete is poured (see, FIGS. 2, 3, and 4). Pairs of bolts 18 are typically located at the foundation corners, with an inch or so of their threaded portions extending above the upper surface of the foundation. Similarly, other bolts are spaced a predetermined distance apart, extending entirely around the foundation's perimeter. The location of each spaced bolt coincides with the location of a vertical joint 19. FIG. 1 shows a number of such vertical joints 19, located between adjoining modular eave wall panels 21. Consequently, the predetermined spacing between the bolts generally corresponds to the standard width of the wall panels 21.

Apertures 22 are drilled in pieces of the lower track 13 to pass the threaded, upper ends of the anchor bolts. At the corners, adjoining pieces of track are secured by means of nuts 23 tightened over washers 24. At the locations of selected joints 19, the pieces of track are secured by means of threaded connector rod couplers 26 and washers 24. Following this procedure, the peripheral lower track 13 is fully assembled and secured to the foundation, in preparation for vertical assembly of the wall panels.

The Structurally Integrated Panels used for eave wall panels 21 are of a relatively small size, compared to prior art panels. For example, eave wall panels 21 are typically 4' wide and 8' or 10' high, although there is nothing critical about these particular dimensions. These smaller SIPS can easily be moved, arranged, and secured into place by two persons, without the use of heavy equipment or other special tools.

All of the SIPS panels used to practice the invention are pre-manufactured at a plant, typically at a location remote from the actual building site. All of the eave wall panels 21 are modular in construction, having an identical size and a rectangular configuration. However, at the building site, the panels may easily be cut and configured, to meet specific fit requirements, such as those existing where panels join at corners. The panels may also be precast or cut on site to accommodate doors, windows, and utility passageways. Such on-site fitting of the panels is easily accomplished through the use of ordinary carpentry tools by one having minimal construction skills. Because of the wide variety of circumstances which may be encountered, no attempt will be made here to describe all of the possible modifications or adaptations to the panels which may be undertaken.

Other SIPS panels, to be described later, are of different sizes and configurations, and they may use somewhat different materials, than the eave wall panels 21. However, the manufacturing and general structural characteristics of these other panels are the same as that for the eave wall panels. Therefore, in the manufacturing process to follow, it should be noted that this process applies for the other panels contemplated herein as well.

At the manufacturing plant, molding frames are provided to maintain an inner skin 27 and an outer skin 28 of finished sheet material in spaced, parallel relation. As is particularly evident in FIGS. 3 and 15, the lower end of outer skin 28 is longer than that of inner skin 27, providing an overlap 30, for covering a portion of the foundation. Alterative constructions of the wall panel, to be described herein, rely upon a separate molding piece to provide a weather tight seal. The inner and outer skins may be of the same or different materials, depending upon the application and the environment of the building. One board product which has been used successfully for the inner and outer skins is HARDIPANEL®, manufactured by James Hardie Building Products, Inc. of Mission Viejo, Calif. HARDIPANEL® is a cementitious fiberboard, which is relatively impervious to the elements. Alternatively, it may be desirable to use a metal outer skin 28, for longevity in exposure to the elements. It may also be desirable to use a composite wood, fiber, or plastic material for inner skin 27, so that skin 27 can be painted or textured.

An elongated steel stud 29 is mounted within a first lateral edge of the panel, extending from the lower edge of the panel to the upper edge. Stud 29 is generally U-shaped in cross-section, having a base portion 31, and two opposing and parallel sidewalls 32 extending therefrom. At the outer end of each sidewall 32, a lip 33 is provided for additional stud rigidity. The stud 29 is positioned between the inner skin and the outer skin, so that an open side 34 of the stud is exposed and facing outwardly (see, FIG. 3). It should also be noted that a portion of the stud's sidewalls protrude from the panel, past the adjacent lateral edges of the skins. One function of the stud 29 is to strengthen the panel, by resisting twisting and bending forces. The stud also acts as a convenient means structurally to connect adjacent panels, through the use of easily installed self-drilling screws. And, since the stud is structurally integrated with the foam and the skins during the curing of the foam, the lateral connections between adjacent panels are sound.

The molding frame also includes pieces which seal off the remaining open edges of the panel. These open edges include the upper edge, the lower edge, and a second lateral edge, parallel to the first lateral edge where the stud is located. The upper and lower edges of the panel are sealed off so that the seal is flush with the respective upper and lower edges of the inner skin. However, the second lateral edge is sealed off with the seal recessed from the edges of the inner and outer skins. The depth of the recess is selected to match the protruding extent of the metal stud 29.

When liquid polyurethane is introduced into the closed off volume of the panel, it quickly expands to fill the entire void. When fully cured, the liquid forms a rigid foam core 25. The core 25 structurally bonds both to the skins and to the stud, resulting in a lightweight yet strong panel having superior insulating qualities. When the panel is removed from the molding frame, an elongated channel or recess 36 is left along the second lateral edge. The combination of the recessed foam and the lateral edge, inner walls of the skins defines the dimensions and shape of the channel 36, extending from the top to the bottom of the panel 21.

Returning now to construction of the building, elongated connector rods 37 are screwed into each of the threaded couplers 26. When so installed, the rods 37 extend vertically to a height slightly higher than the panels 21. As shown in FIG. 15, the lower edge of a first panel is aligned with the lower track, and lowered into place, partially within and partly outside the track. The inner skin 27 slides into the track, in snug relation with the inner surface of adjacent side portion 16 of the lower track. The outer skin 28 fits outside the track, with the lower overlap 30 extending down along foundation 12. During the molding of the panel, a thermal break strip 38 may be placed between the adjacent sidewall 32 of the stud and the outer skin 28. This thermal break strip is not essential to practice the invention. However, it should prove advantageous for energy efficiency in some climates.

Figure 6:
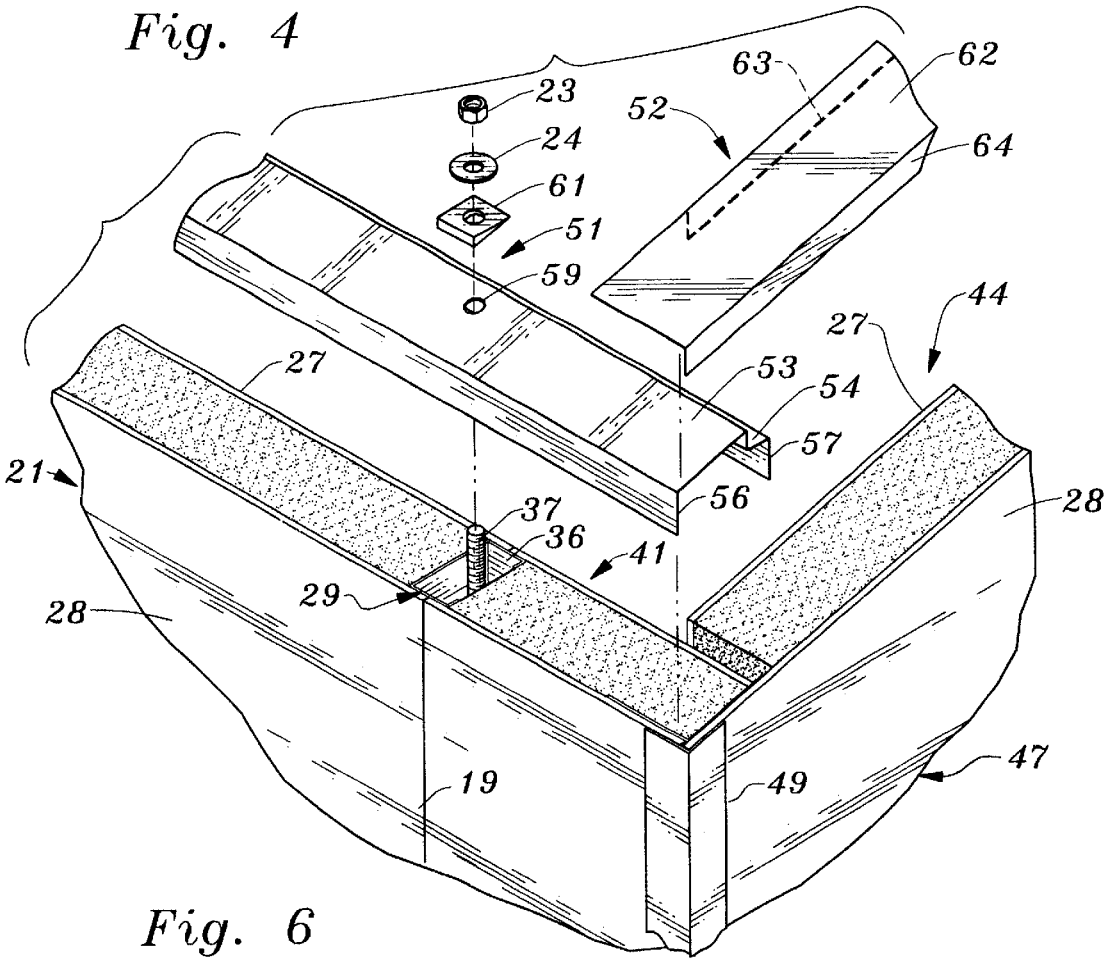
FIG. 6 is a fragmentary perspective view of a typical upper corner, showing portions of three wall panels, the upper tracks, and the upper end of the connection rod.

The first panel is positioned along the track so that the connector rod is located within the open side of the stud 29 Then, a second panel is installed within the lower track, with the panel's second lateral edge, containing the channel 36, facing the open side of the stud 29 of the first panel. The second panel is slid into engagement with the first panel, with the connector rod extending vertically between the engaged edges of the panels. (see, FIGS. 6 and 7). Adjacent lateral edges of the inner and outer skins for each panel are spaced approximately 3/16" apart, and the elongated channel 36 accommodates the protruding portion of the stud 29. The inner and outer skins of the second panel overlap and substantially cover the protruding portion of the stud's sidewalls 32. And, the lips 33 of the stud are spaced slightly from the foam core 25 of the second panel. Self-drilling screws 39 are screwed through the inner and outer skins of the panels, to secure the panels to the lower track and to secure the overlapping skins of the second panel to the stud 29 of the first panel.

Figure 7:
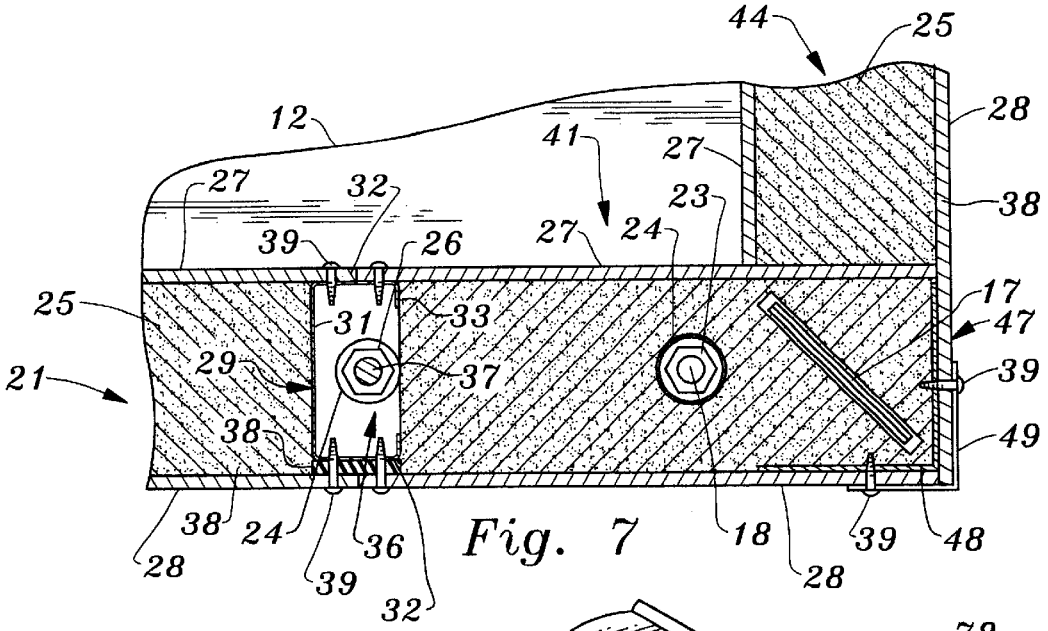
FIG. 7 is a fragmentary, cross-sectional view taken along the line 7—7 in FIG. 1.

The assembly process for full size wall panels is continued along the perimeter of the foundation until a corner is reached. FIGS. 3 and 7 most clearly show the assembly of wall panels meeting in a corner. As was explained earlier, the wall panels may be cut to size at the building site, to accommodate a smaller wall dimension than the standard width, or in this case, to effect a joinder of wall panels at a corner. A narrow eave wall panel 41 is shown in FIG. 3. It should be noted that eave panel 41, on its left hand side, includes the standard, second lateral edge, including the elongated channel 36 to accommodate the adjacent stud 29. It does not, however, include a standard first lateral edge, or a stud, as the panel has been cut to a shorter width, to fill the distance between the vertical joint 19 and the comer. This results in a flush cut end 42 for the narrow eave wall panel 41. Alternatively, a bevel cut may be used, but the flush cut is preferred as it is simple and quick to fabricate. Self-drilling screws 39 are also used to secure the outer skin 28 to the stud of the adjacent wall panel, and to the lower track, as described above.

Along the gable end of the building, Structurally Integrated Panels of a slightly different size and configuration are used. FIG. 1 shows a standard rake wall panel 43 and a narrow rake wall panel 44. The rake wall panels are identical to the previously described eave wall panels, except they are higher and have a raked upper edge 46. This raked upper edge could be pre-manufactured at the factory, or it could be fabricated at the building site, as assembly of the building progresses. All rake wall panels, except those cut narrower to fit a special space, include the same features of the structurally integrated metal stud and the elongated channel, discussed above. Likewise, the rake wall panels are secured to the lower track and to each other in identical fashion as the eave wall panels 21.

FIGS. 3 and 7 best illustrate how short rake wall panel 44 is specially fabricated to meet with the short eave wall panel 41 in the corner. By cutting away a portion of inner skin 27 and the foam core 25, an end cap 47 is formed from the end portion of outer skin 28. The width of the cut-away portion corresponds to the transverse dimension of panel 41. An inner steel angle corner insert 48 may be installed over the end of the panel 41, having a portion covering the flush cut end and another portion sandwiched between the outer skin and the foam core. In this way, when the two panels are joined, end cap 47 covers the underlying portion of the insert 48 (see, FIG. 7). Then, an outer steel angle corner cover 49 may be installed over the end cap 47 and the outer skin of panel 41, and fastened to the inner steel angle insert by means of self-drilling screws 39. Alternatively, separate trim pieces may be used to finish off building corners.

In similar fashion, additional eave and rake wall panels are installed into the lower track, and cut to fit where necessary, so that the wall is extended around the entire periphery of the foundation. As explained above, at the location of selected joints 19, a connector rod 37 is threaded into a respective rod coupler 26, before an adjoining pair of panels is snugged together An alternative construction for eave wall panel 21 is shown in FIG. 3A. It should be noted that in this construction, the open side of the stud 26 is oriented so that it is facing toward the adjacent terminus of the core 25. The open side and the interior volume of the stud are thereby maintained free from foam, so that a connector rod 37 may pass therethrough. It will be appreciated also, that in assembling such panels, base 31 and protruding portions of sidewalls 32 of one panel fit into channel 36 of an adjacent channel.

Figure 5:
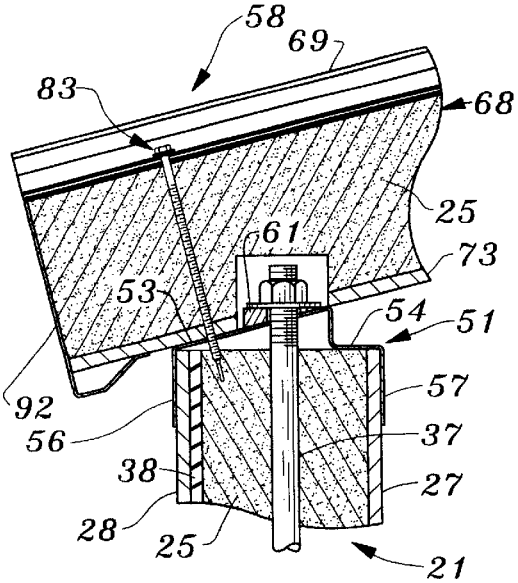
FIG. 5 is a fragmentary, vertical, cross-sectional view of a typical wall to roof connection taken along the line 5—5 in FIG. 1, showing the roof and wall panels, the upper track, and the upper end of the connection rod.

For additional strength in the wall panel assembly, an upper eave track 51 and an upper rake track 52 are provided. Upper eave track 51 has an angled portion 53, a step portion 54, and depending edges 56 and 57. Angled portion 53 supports a roof assembly 58, and is inclined at an angle to correspond to the desired rake of the roof assembly (see, FIG. 5). Track 51 includes apertures 59 to pass an upper end of each connector rod 37, as each track section is slid down over the upper edges of eave panels 21 and 41. Track 51 is sized so that edges 56 and 57 fit snugly over outer skin 28 and inner skin 27. An angled washer 61 and a circular washer 24 are then placed over each connector rod's upper end, before a nut is threadably secured over the rod.

An alternative construction for upper eave track 51 is a simple inverted U-shaped track, having a flat portion overlying the upper edges of the panels, and depending edges overlying inner and outer skin portions. A solid or formed wedge piece may be used over the flat portion, to support the roof panels and distribute weight on the track. Preferably, the wedge piece would include apertures for passing the upper ends of the connector rods, and be bolted to the track.

Figure 19:
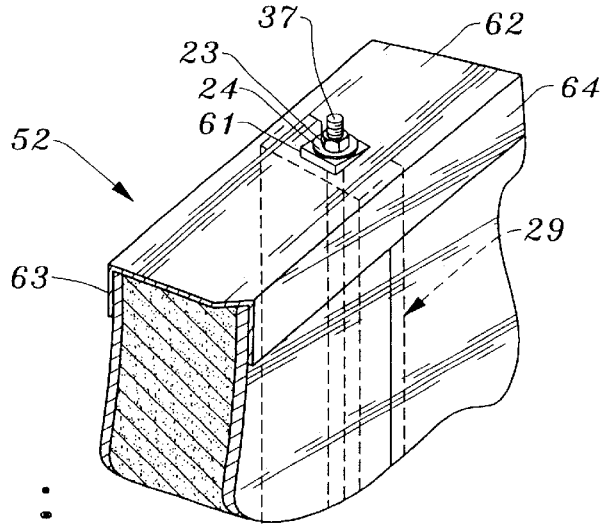
FIG. 19 is a fragmentary detail view of an upper track and adjoining rake wall panels, taken on the line 19—19 in FIG. 1.
Figure 20:
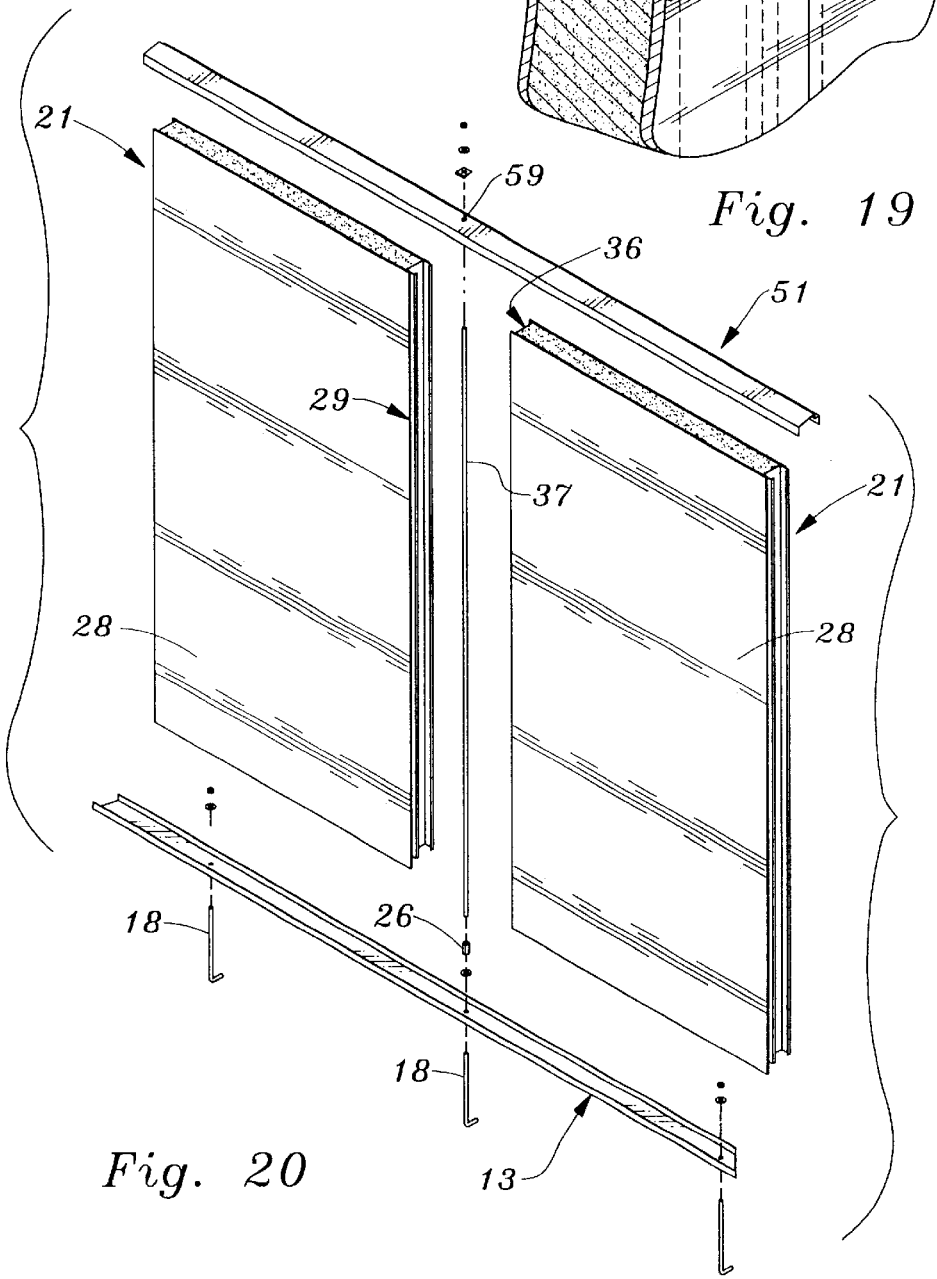
FIG. 20 is an exploded perspective view, showing a general assembly of a pair of wall panels, the connector rod, and the upper and lower tracks; and, FIG. 21 is a longitudinal, fragmentary, cross-sectional view taken through a joint between two adjacent wall panels.
Figure 21:
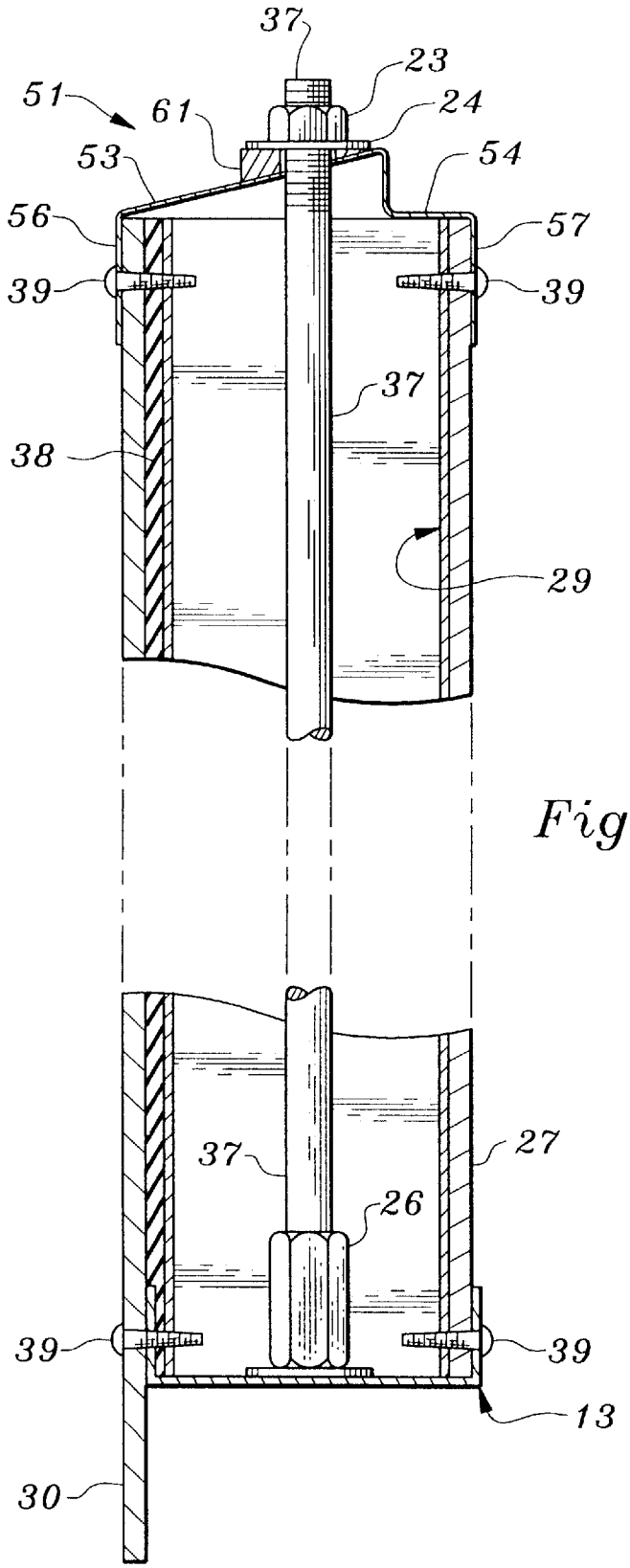

The upper rake track 52 has a flat portion 62, depending edges 63 and 64, and apertures 59. These apertures are located to pass the upper end of each connector rod extending above the rake panels. Where the upper rake and eave tracks meet in the corners, they are cut to fit together. This may be done in a variety of ways, such as the interlocking, overlap fit shown in FIG. 6, or a simple bevel cut. After the rake track 52 is slid down over the upper edges of rake panels 43 and 44, washers 61 and 24 are installed over the upper ends of the connector rods 37. The rod and upper rake track assembly is finally secured by means of a nut 23, as shown in FIG. 19. During this initial phase of the track installation, each nut is only partially tightened, as some adjustment of the wall panels and other components may be necessary before final tightening.

This process is continued, until rake and eave upper tracks are installed over the upper edges of all of the wall panels. Then, all of the wall components assembled thus far undergo a final inspection for proper installation and fit. Lastly, all of the nuts 23 extending around the upper track are fully tightened. Because the connector rods 37 are mechanically secured to the foundation, the act of tightening the nuts 23 compressively secures the assemblage of the upper track, the eave and rake wall panels, and the lower track.

Cutouts for a door 66 and a window 67 may be made during panel manufacture or on the jobsite, either before or after the wall panels are erected and assembled. The skins 27 and 28 and the core 25 are easily cut using a circular saw or a hand saw. Then, the cutout is framed using steel track inserts, and the door and windows are installed in the usual way. It is also possible to route plumbing or electrical circuits on or within the wall panels, depending upon aesthetic and functional considerations. For example, the inner skin and a portion of the core could be removed with a router so that plumbing lines or electrical conduit could be installed within the panel. Then, the lines or conduit could be covered with plaster and the remaining surface sanded smooth.

Attention is now directed toward the roof assembly 58. A construction for the roof assembly 58 is disclosed herein which employs a plurality of elongated, modular roof panels 68. Although the dimensions of the roof panels are not critical in any way, they are preferably 2' wide, from a first lateral edge to a second lateral edge, and 10' to 16' long, from an upper edge to a lower edge. These roof panels enjoy the same economies of manufacture and simplicity of installation as the modular wall panels, discussed above. However, owing to the particular demands of the roofing application, there are some structural differences between the two panels which are worth noting.

Panels 68 include an outer skin 69, preferably fabricated from a metal which is both bendable and appropriately covered with a weather-resistant protective coating. It is also possible that plastic, or other moldable material, may be used in lieu of metal, for the skin 69. For additional strength, corrugations 71 may be prefabricated or molded in the skin, before the core of the roof panel is poured. A joinder corrugation 72, having a greater height and a different configuration than that of the standard corrugations, is included in outer skin 69, along the second (left) lateral edge of the panel 68.

The roof panels 68 also have an inner skin 73, preferably planar in configuration. In this manner, the roof panels will lie flat on the underlying portions of the upper track, and provide some degree of weather protection therewith. Inner skin 73 may be manufactured from the same material as that used for inner skin 27, or any other suitable material. As with the skins of the wall panels, the inner and outer skins of the roof panels are generally parallel to each other, and arranged in spaced relation. This spacing, which may range from 2 to 8 inches, or so, defines the thickness of the roof, and significantly affects the ultimate weight and R-factor of the roof as well.

Figures 9, 10:
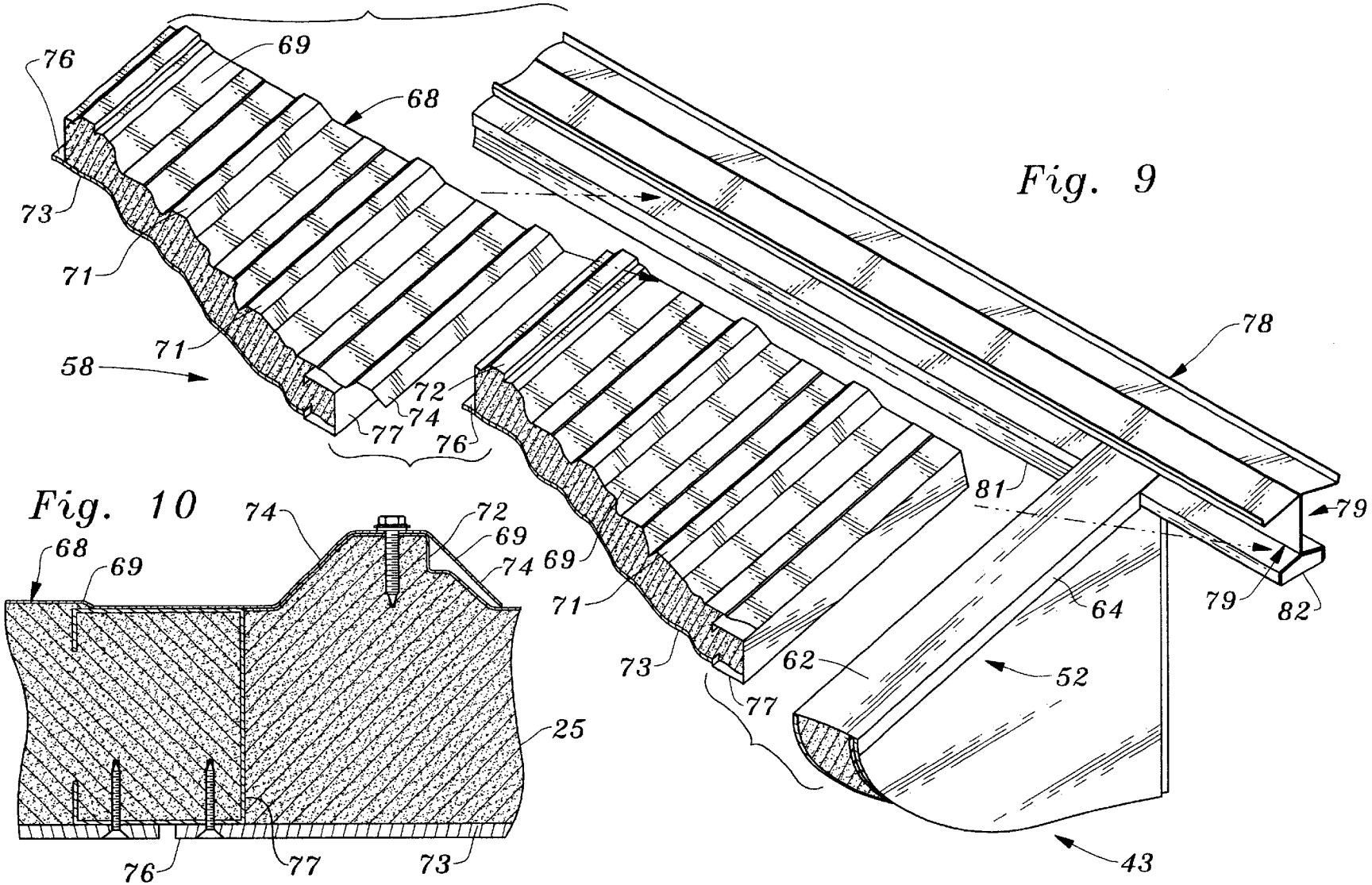
FIG. 9 is a fragmentary, perspective view of a ridge beam and portions of roof panels and an eave wall panel.
FIG. 10 is a fragmentary, cross-sectional view of the juncture of two roof panels.

The inner and outer skins are also arranged in a slightly horizontally offset relation, most evident in the panels 68 shown in FIG. 9. Outer skin 69 has a joinder portion 74, extending outwardly from the panel and along the entire extent of the first (right) lateral edge. This joinder portion is sized and configured perfectly to overlap the joinder corrugation 72, of an adjoining roof panel (see, FIG. 10). Inner skin 73 has a narrow shelf 76 extending outwardly from the panel, and along the entire extent of the second lateral edge of the panel. Sandwiched between the inner and outer skins, along the entire extent of the first lateral edge of the panel is a metal stud 77. The stud 77 is oriented so that its open side is facing toward the core 25.

In manufacturing a roof panel, the inner skin 73, the outer skin 69, and the stud 77 are all secured within a molding frame, with the remaining open edges sealed off. Foam is then introduced into the void within the roof panel. The chemical reaction causes the foam to expand, filling the entire void. When the foam has cured, a core 25 is formed, providing strength and rigidity to the panel and holding fast together the skin and stud components. These roof panels are then transported to the building site for assembly.

Figure 8:
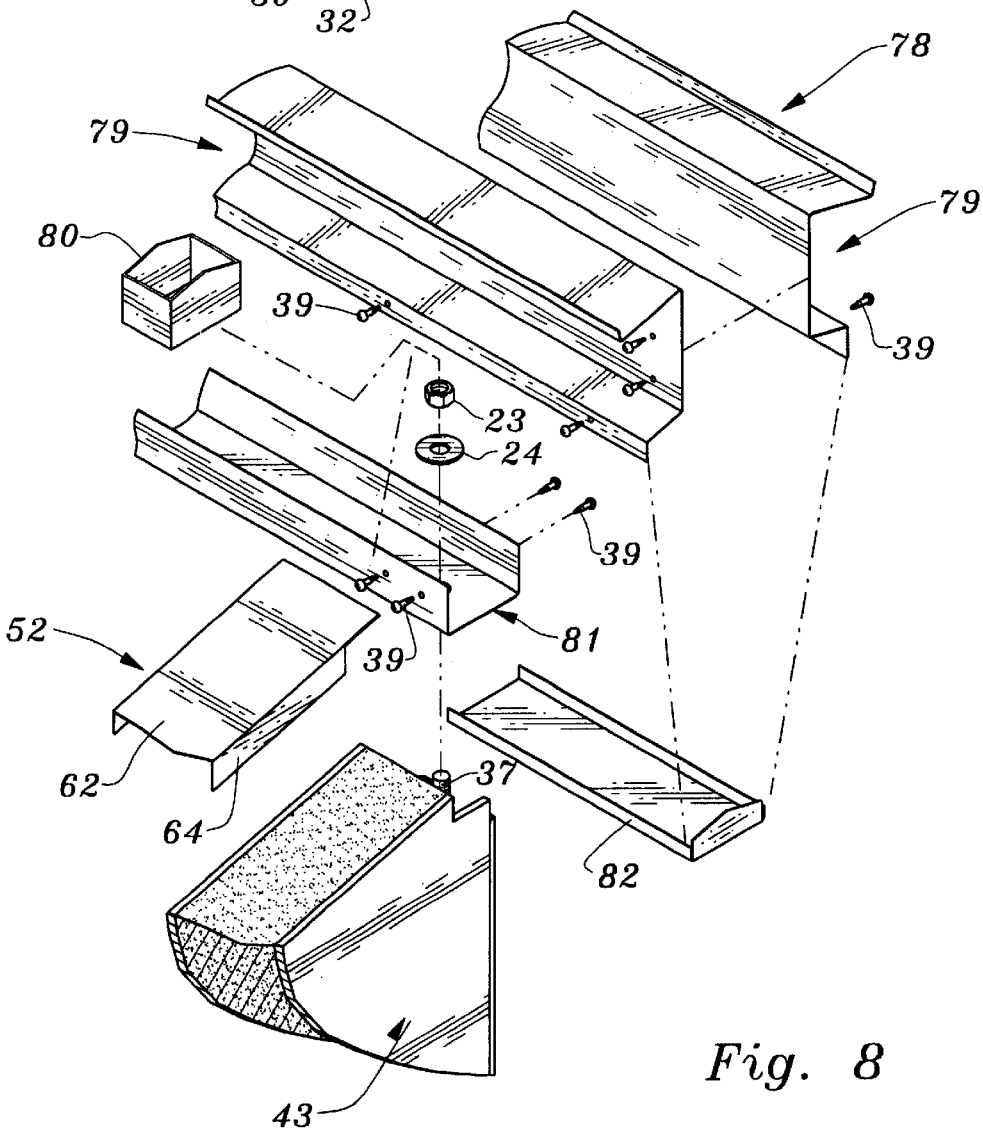
FIG. 8 is a fragmentary, exploded, perspective view of the ridge beam components and an eave wall panel.
Figure 12:
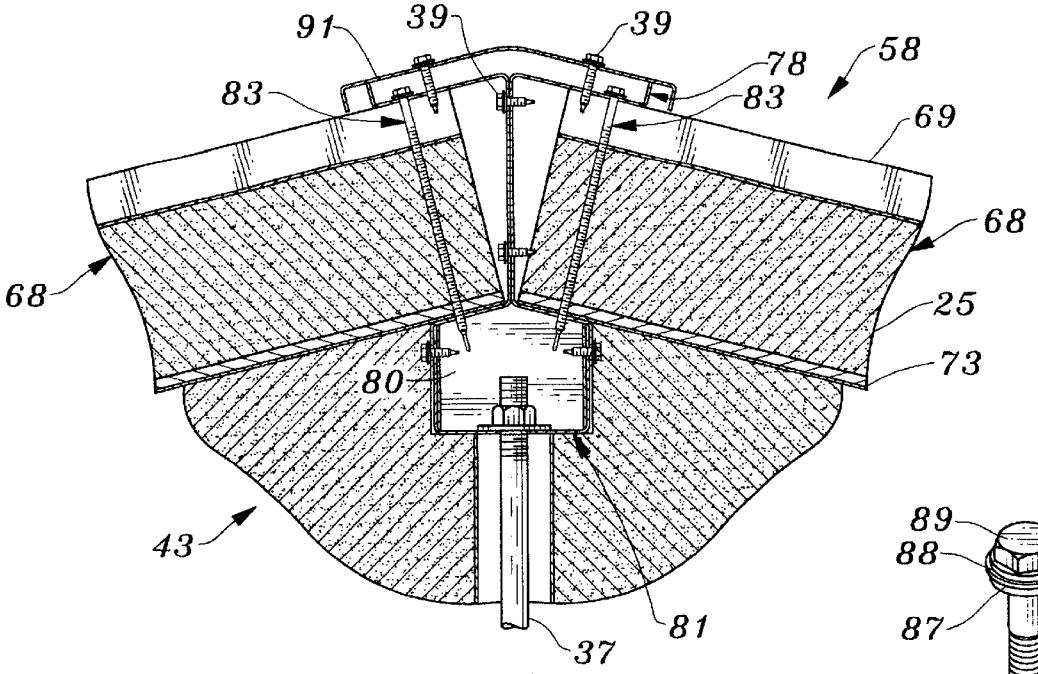
FIG. 12 is a fragmentary, cross-sectional view taken along the line 12—12, in FIG. 1.

As a primary support for the roof assembly 58, an open flange ridge beam 78 is provided. Beam 78 spans the entire ridge of the building, and extends slightly beyond each gable end as well. The beam is comprised of two pieces, each including an open flange 79 sized to accommodate an upper end of each roof panel 68. To provide additional strength to the ridge beam, a box beam 81 is secured to its underside, extending between gable ends. The dimensions of the box beam are determined by the length of the ridge beam. For example, for short ridge beams, the box beam may be 2" high and 4" wide. For longer spans, the box beam may be 8" high and 4" wide, or larger.

Where the beam 78 rests upon each gable end, a beam stiffener 80 is installed, to transfer and distribute forces. Stiffener 80 has an open top and an open bottom, and peripheral sidewalls (see FIG. 8). The stiffener 80 is installed between the sidewalls of box beam 81, directly over the apex of the gable end and connector rod 37 (see FIG. 12). Stiffener 80 is fastened securely in place with self-drilling screws 39, screwed through the sidewalls of the box beam and into the stiffener 80. The undersides of the portions of the ridge beam which extend beyond the gable ends are enclosed by ridge beam cover plates 82. Self-drilling screws 39 are used to secure these various components together.

Figure 11:
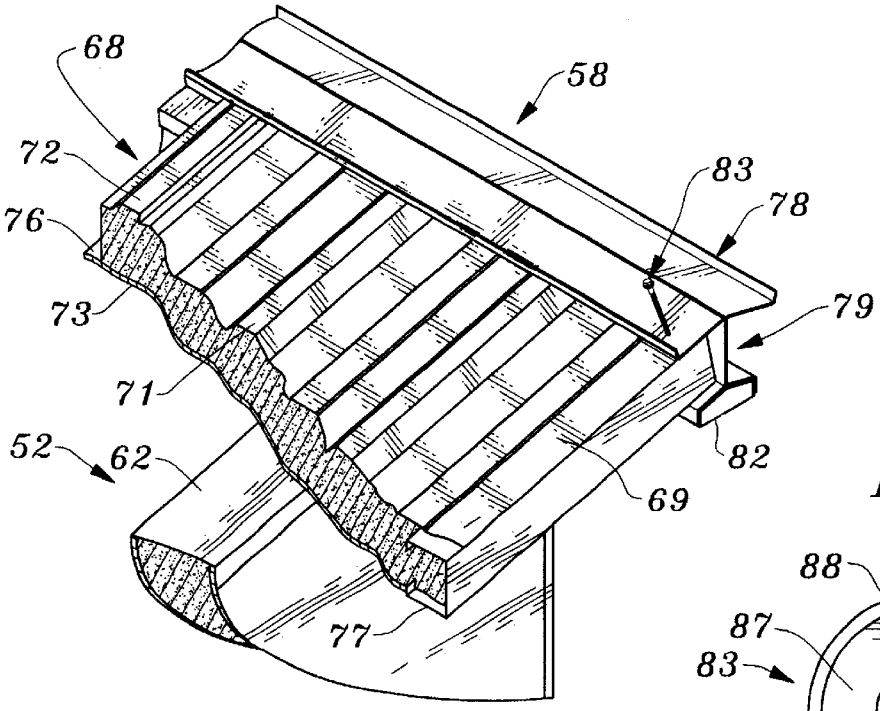
FIG. 11 is a fragmentary, perspective view of the ridge beam assembly, a roof panel, and an eave wall panel.
Figure 14:
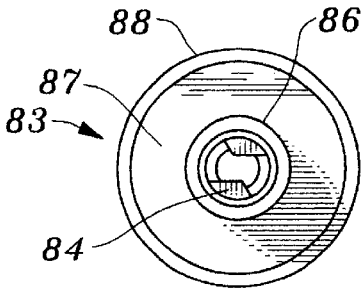
FIG. 14 is a bottom plan view of the fastener in FIG. 13.

Making reference to FIG. 11, a first roof panel 68 is slid over the upper eave track 51, into a respective location within an open flange 79. The joinder portion 74 of this panel may either be bent over the exposed stud 77, and secured thereto with sheet metal screws, or portion 74 may be cut off In the later event, the stud 77 would be covered by a separate trim piece, not shown in the drawings.

Figure 13:
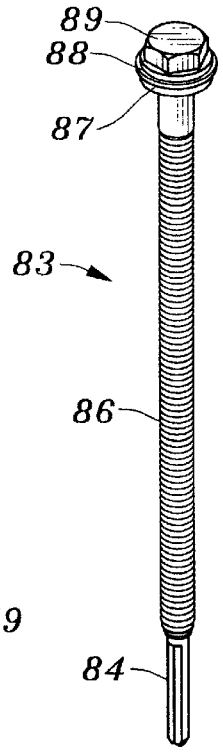
FIG. 13 is a perspective view of a self-threading roof and wall panel fastener.

A special roof fastener 83 is used to secure the roof panels both to the ridge beam and to the upper eave track. As shown in FIG. 13, fastener 83 is particularly elongated, including a reduced diameter drilling portion 84 at its lower end, and a self-tapping threaded portion 86 over most of the remaining shank. A neoprene washer 87 and a metal washer 88 are also provided under the combined hex nut and flange 89 on the upper end of the fastener 83. When the fastener 83 is driven into the ridge beam, the drilling portion 84 fabricates a reduced diameter hole through the upper section of the ridge beam, the various layers of the panel, and the lower section of the ridge beam (see, FIG. 12). As the larger diameter self-tapping threads progress downwardly, the fastener tightly secures the roof panel to the ridge beam. The neoprene washer seals the entry hole for the fastener from weather. Similarly, at the lower end of the roof panel, the fastener passes through the roof panel into the underlying upper eave track. In like manner, the self-tapping threaded portion of the fastener secures the panel to the upper eave track.

A second roof panel 68 is slid into position, next to the first panel. Before the upper end of the second roof panel enters the open flange 79, joinder portion 74 is positioned over joinder corrugation 72 of the first panel. At that point, a portion of the stud 77 of the second panel overlies the shelf 76 of the first panel, and another portion of the stud is in snug abutment with the core 25 of the first panel. The fasteners 83 are then installed in the second panel in identical fashion to that employed for securing the first panel.

Successive roof panels are installed across both sides of the ridge beam until the entire roof is completed. A piece of ridge flashing 91 is secured over the top of the ridge beam, for sealing off that assembly from weather elements. Sheet metal screws with neoprene washers are used for securement (see, FIG. 12).

At the lower end of the roof panels, an end plate 92 may also be provided, to protect the core and the drip ends of the skins from the weather. (See, FIG. 5).

A conventional roof structure can also be used for building 11. For example, a corrugated metal construction could easily be adapted for this application, providing the unsupported spans of roofing were not too great. Also, if supportive runs of stringers extended in parallel fashion from the eaves to the ridge, a wood shingle roof could be used. And, the combination of plywood covered by composite asphalt shingles is another obvious alternative for an alternative roofing structure.

In the event that a particularly large building is to be constructed, the single gable end supported ridge beam described thus far may not be strong enough to support the roof FIG. 1 shows an exemplary girder truss assembly 93 which can be employed for such applications. As opposed to conventional construction, where the girder truss rests on the upper ends of the eave wall, the assembly 93 rests upon columns 94. These columns typically would be placed along the inner wall, but would not place any significant lateral stress or forces upon the wall. This adaptation allows use of the same modular wall panels for larger building constructions, without relying upon the walls for supporting the bulk of the weight of the roof system.

Further modifications to the basic building design include alternative constructions for the lower track. These alternative tracks are shown in FIGS. 16–19. A generally Z-shaped lower track 96 is disclosed in FIG. 16. This construction eliminates the necessity for a groove in the bottom of the thermal break strip 38, to accommodate the upwardly extending side portion 16 of the lower track (see FIG. 15), yet still allows the overlap 30 of outer skin 28, to provide a weather-tight seal against the foundation 12.

Figure 17:
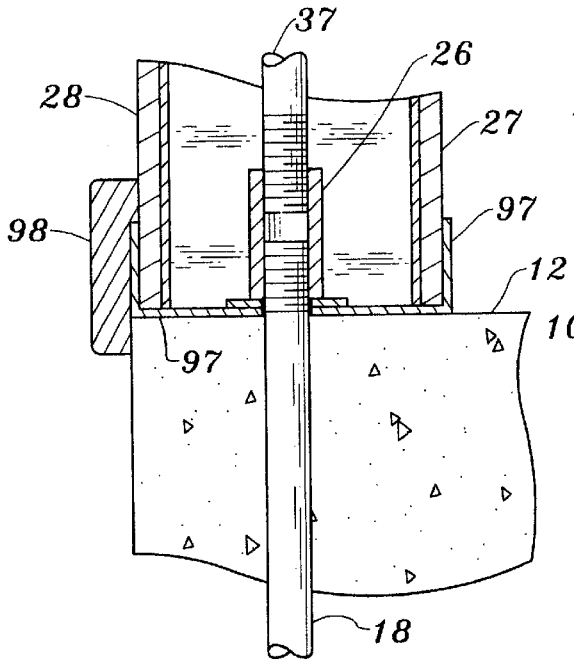
FIG. 17 is a view as in FIG. 15, but showing a third embodiment of a lower track.

Another lower track 97 is illustrated in FIG. 17. Track 97 is generally U-shaped in configuration, much like track 13. However, track 97 is slightly wider in transverse dimension than track 13, allowing the wall panel, including skins 27 and 28, to fit entirely within the track. To provide a weather-tight seal, a trim piece 98 is included, covering the exposed lip of the track and a small portion of skin 28.

Figure 16:
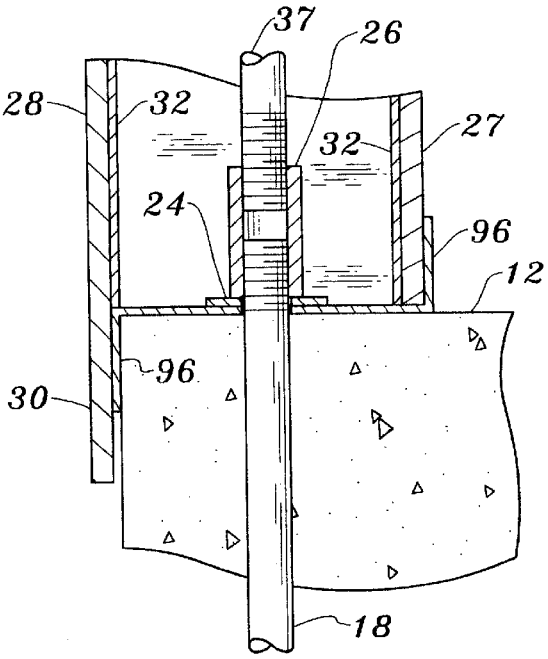
FIG. 16 is a view as in FIG. 15, but showing a second embodiment of a lower track.
Figure 18:
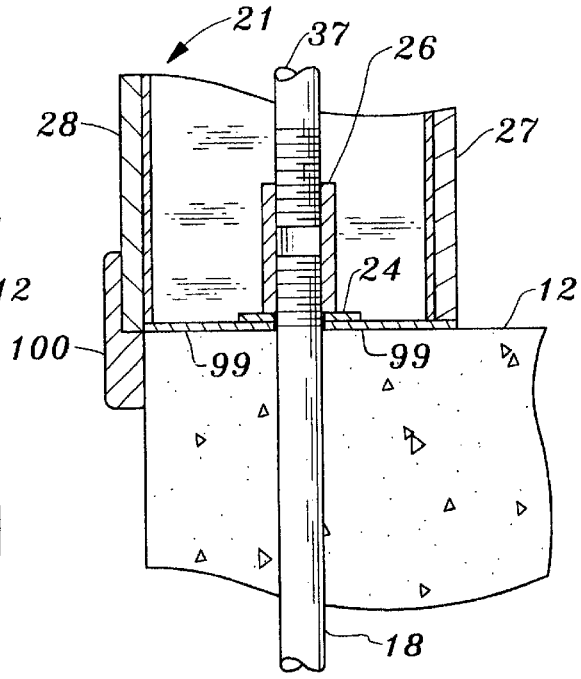
FIG. 18 is a view as in FIG. 15, but showing a fourth embodiment of a lower track.

In FIG. 18, the simplest construction for a lower track 99 is disclosed. Track 99 is simply an elongated strip of material, which lies flat on the foundation and includes no upwardly or downwardly extending lips or side portions. No panel securement or panel registration feature is provided by this construction. If outer skin 28 includes an overlap 30, as shown in FIGS. 15 and 16, then no additional trim piece is necessary. However, if skin 28 ends at the upper level of the foundation, as shown in FIG. 18, a trim piece 100 is used to seal the panel to foundation interface. It should also be evident that one could still practice the invention herein by entirely eliminating the lower track altogether, by foregoing the additional securement and self registration features it provides.

What is claimed is:

1. A modular panel for use in a building construction, comprising:

a. an outer skin;

b. an inner skin, substantially parallel to and co-extensive with said outer skin, said inner and outer skins being arranged in spaced relation, thereby defining an upper edge, a lower edge, a first lateral edge, and a second lateral edge for said panel;

c. an elongated stud located within said first lateral edge between said inner and outer skins, said stud extending from said upper edge to said lower edge, said stud having a base extending between said inner skin and said outer skin and sealing off said first lateral edge, said stud being generally U-shaped in cross section, including sidewalls extending from said base defining an open side; and, d. a foam core, said core substantially filling a void between said outer skin and said inner skin, and extending from said upper edge to said lower edge and from said second lateral edge to said base of said stud, said stud being oriented so that said open side faces outwardly from said core.

2. A panel as in claim 1 in which portions of said sidewalls protrude outwardly from said panel, and in which said second lateral edge includes a recess extending from said upper edge to said lower edge, said recess being sized and configured to accommodate said protruding portions.

3. A panel as in claim 1 in which said outer skin is metal.

4. A panel as in claim 1 in which said core is manufactured from a polystyrene or a polyurethane liquid foam structurally bonded both to said inner and outer skins and to said stud.

5. A modular building construction, comprising:

a. a foundation having an upper surface with a periphery extending therearound;

b. a plurality of connector bolts spaced around said periphery a predetermined distance from each other, said bolts having a portion secured within said foundation and another portion extending above said upper surface;

c. a lower track having apertures to pass said connector bolts, and including means engaging said bolts to secure said lower track to said foundation;

d. a plurality of modular wall panels extending around said periphery each of said panels having a width corresponding generally to said predetermined distance and including: an outer skin substantially parallel to and co-extensive with an inner skin, said inner and outer skins being arranged in spaced relation, thereby defining an upper edge, a lower edge, a first lateral edge, and a second lateral edge for said panel; an elongated stud located within said first lateral edge between said inner and outer skins, said stud extending from said upper edge to said lower edge, said stud having a base extending between said inner skin and said outer skin and sealing off said first lateral edge, said stud being generally U-shaped in cross section including sidewalls extending from said base defining an elongated open side; and, a foam core, said core substantially filling a void between said outer skin and said inner skin, and extending from said upper edge to said lower edge and from said second lateral edge to said base of said stud, said lower edge of each of said panels being positioned between two of said connector bolts and overlying said lower track;

e. a plurality of connector rods extending from an upper end of each of said connector bolts through said elongated open side, said connector rods having upper ends slightly higher than said upper edges of said panels;

f. an upper track having apertures to pass said upper ends of each of said connector rods; and, g. fastener means attached to said upper ends of said connector rods, for compressively securing said upper track over said upper edge of said panels and said lower edge of said panels against said lower track, said plurality of modular wall panels thereby being secured and arranged to form a wall panel assembly for the modular building.

6. A modular building construction as in claim 5 in which said lower track is generally U-shaped in cross-section, having a horizontal portion and upwardly extending side portions, and in which at least said inner skin of said panels is in contingent relation with an inner one of said side portions.

7. A construction as in claim 6 in which said outer skins of said panels include an overlap portion extending downwardly at said lower edge, said overlap being located outside an outer one of said side portions and covering an exterior side of said outer side portion and a portion of said foundation.

8. A modular building construction as in claim 5 in which said lower track is generally Z-shaped in cross-section, having a horizontal portion, an upwardly extending inner side portion, and a downwardly extending outer side portion.

9. A modular building construction as in claim 5 in which said lower track is generally U-shaped in cross-section, having a horizontal portion and upwardly extending side portions, and in which said inner skin of said panels is in contingent relation with an inner one of said side portions and said outer skin of said panels is in contingent relation with an outer one of said side portions.

10. A modular building construction as in claim 5 in which said lower track is an elongated strip of material which lies on said upper surface of said foundation.

11. A modular building construction as in claim 5 in which a portion of said stud partially protrudes from said first lateral edge, and in which said second lateral edge of said wall panels includes an elongated channel extending from said upper edge to said lower edge, said channel being sized and configured to accommodate said partially protruding portion of said stud when a first lateral edge of one panel is joined with a second lateral edge of another panel to form said wall panel assembly of the modular building.

12. A modular building construction as in claim 5 in which said wall panels include eave wall panels and rake wall panels, said eave wall panels being of identical height and located along an eave portion of said periphery, and in which said rake wall panels have raked upper edges defining a roof rake and a ridge, said rake wall panels being located along a gable portion of said periphery.

13. A modular building construction as in claim 12 in which said upper track includes an upper eave track mounted on said upper edges of said wall panels extending along said eave portion of said periphery, said upper eave track having an angled portion, a step portion, and edge portions depending from an outer edge of said angled portion and from an inner edge of said step portion, said angled portion having an inclination corresponding to that of said roof rake.

14. A modular building construction as in claim 13 further including a roof assembly, said roof assembly comprising:

a. a ridge beam extending along said ridge between a first gable end and a second gable end, said ridge beam including a pair of open flanges on either side of said ridge, said flanges being directed toward a respective eave track;

b. a plurality of elongated roof panels, each of said panels having an upper edge inserted in a respective one of said open flanges and a lower edge, extending beyond a respective said eave track, each of said panels having a first lateral edge and a second lateral edge, extending between said upper and lower edges, said panels being arranged and assembled in side to side, parallel relation, with a first lateral edge of one panel being joined to a second lateral edge of an adjacent panel; and, c. fastener means for joining said panels to each other and to a respective said open flange and a respective said eave track, forming a roof assembly connected to said wall panel assembly of the modular building.

15. A modular building construction as in claim 14 in which said roof panels comprise: an outer skin; an inner skin, substantially parallel to and co-extensive with said outer skin, said inner and outer skins being arranged in spaced and slightly horizontally offset relation, thereby defining an upper edge, a lower edge, a first lateral edge, and a second lateral edge for said panel, said outer skin having a joinder portion extending outwardly from said panel and along said first lateral edge and a joinder corrugation extending along said second lateral edge, said joinder portion being sized and configured to overlap a joinder corrugation of an adjacent panel, and said inner skin having a shelf extending outwardly from said panel and along said second lateral edge; an elongated stud located within said first lateral edge between said inner and outer skins, said stud extending from said upper edge to said lower edge, said stud being generally U-shaped in cross-section, including sidewalls extending from a base defining an open side, and in which said stud is oriented so that said open side faces inwardly toward said panel; and, a foam core, said core substantially filling a void between said outer skin and said inner skin, and extending from said upper edge to said lower edge and from said second lateral edge to said base.

16. A modular panel for use in a building construction, comprising:

a. an outer skin;

b. an inner skin, substantially parallel to and co-extensive with said outer skin, said inner and outer skins being arranged in spaced relation, thereby defining an upper edge, a lower edge, a first lateral edge, and a second lateral edge for said panel;

c. an elongated stud, said stud being generally U-shaped in cross-section including sidewalls extending from a base defining an open side, said stud being located within said first lateral edge with said base extending between said inner and outer skins and oriented so that said open side faces inwardly, said stud extending from said upper edge to said lower edge; and, d. a foam core, said core substantially filling a void between said outer skin and said inner skin, and extending from said top edge to said bottom edge and from said second lateral edge to said open side of said stud, leaving said open side and an interior volume of the stud free from foam.

* * * * *